United States Patent [19]

Richter

[11] 4,057,461

[45] Nov. 8, 1977

[54] METHOD AND APPARATUS FOR IMPREGNATION OF FIBER MATERIAL BY PRESSURE PULSATION

[75] Inventor: Johan C. F.C. Richter, Nice, France

[73] Assignee: Kamyr Aktiebolag, Karlstad, Sweden

[21] Appl. No.: 690,786

[22] Filed: Aug. 27, 1976

[30] Foreign Application Priority Data

June 2, 1975 Sweden ..... 7506255

[51] Int. Cl.[2] ..... D21C 3/26; D21C 7/00

[52] U.S. Cl. ..... 162/19; 162/52; 162/61; 162/237; 162/238; 162/246; 162/DIG. 2

[58] Field of Search ..... 162/19, 52, 237, 238, 162/246, 61, DIG. 2

[56] References Cited

U.S. PATENT DOCUMENTS

| | | | |
|---|---|---|---|
| 480,334 | 8/1892 | Maste | 162/68 |
| 2,474,862 | 7/1949 | Richter | 162/238 |
| 2,985,236 | 5/1961 | Ranhagen | 162/19 |
| 3,532,594 | 10/1976 | Richter | 162/19 |
| 3,874,996 | 4/1975 | Pradt | 162/246 |

FOREIGN PATENT DOCUMENTS

| | | | |
|---|---|---|---|
| 708,382 | 4/1965 | Canada | 162/246 |
| 2,361,627 | 6/1974 | Germany. | |

*Primary Examiner*—S. Leon Bashore
*Assistant Examiner*—William F. Smith
*Attorney, Agent, or Firm*—Cushman, Darby & Cushman

[57] ABSTRACT

An apparatus and method for impregnating fiber material with treatment liquid before treatment thereof in a high pressure vertical fiber material treatment vessel. Fiber material and treatment liquid under relatively low pressure flow in a first flow system, continuous withdrawal of liquid from the first system taking place. A second flow system of fiber material and treatment liquid, under relatively high pressure (the second flow system including an impregnation portion of the treatment vessel), is provided. Fiber material entrained in liquid in the first system is transferred to the second system, and the pressure thereof boosted, by a pocketed-rotor transfer device. Communication between the second system and the treatment vessel is selectively allowed or blocked by a valve disposed in a funnel-shaped conduit between the impregnation chamber of the treatment vessel and the treatment vessel, the pressure in the second system being substantially as high as the treatment vessel pressure when communication between the second system and the treatment vessel is allowed, and the pressure in the second system becoming significantly reduced when communication between the second system and the treatment vessel is blocked. The time that communication between the second system and the treatment vessel is allowed is effectively controlled so that the relative times that the second system is exposed to high and low pressure effects impregnation of fiber material with treatment liquid in the second system.

15 Claims, 3 Drawing Figures

METHOD AND APPARATUS FOR IMPREGNATION OF FIBER MATERIAL BY PRESSURE PULSATION

BACKGROUND AND SUMMARY OF THE INVENTION

The invention relates to an apparatus and method for impregnating fiber material with treatment liquid, especially with digesting liquid, before treatment of the fiber material, especially before digestion thereof. The pre-impregnation of fiber material with treatment liquid constitutes a very important part of the delignifying process in the production of pulp, the object of the pre-impregnation being to replace the air or gas content of the fiber material with the impregnation liquid. Conventionally, the air or gas is replaced by the utilization of steam at a small super-atmospheric pressure, followed with the submersion of the fiber material in treatment liquid at higher pressure and temperature. Also, initial vacuum treatment and pressing, followed by submersion in treatment liquid, is known. Whatever prior art conventional methods are utilized, a certain amount of equipment is necessary. it is desirable — both for economical and space saving reasons — to limit the amount of impregnation equipment necessary as much as possible. At the same time, no decrease in the efficiency of the impregnation process is tolerable.

Swedish Pat. No. 174,656 teaches the impregnation of fiber material by pressure variations of the impregnating liquid. According to the teachings of this Swedish patent, the readily-impregnable fiber material is led away from an impregnation chamber more quickly than the less readily-impregnable fiber material. The impregnation vessel is a long, sloping structure to which a mixture of fiber material and digesting liquor at pressure is fed by means of one assembly, and is withdrawn by means of another assembly. A conveyor for the impregnated fiber material is disposed within the impregnation vessel, and the air that is displaced is withdrawn, and the pressure variations are obtained by means of a vacuum pump and/or a liquor tap-off means. The structure of the Swedish patent is relatively complex, a great deal of accessory equipment being necessary.

According to the apparatus and method of the present invention, impregnation through pressure variations may take place with the utilization of a minimum amount of accessory equipment. Essentially, according to the present invention, the only accessory equipment that is necessary is a valve in a conduit in the treatment vessel (and various pressure sensitive and time and pressure responsive control means for the valve) and a screening device. A conventional continuous digester or other treatment vessel and conventional pocketed-rotor transfer device, such as devices produced by Kamyr Inc., may be utilized, along with a feed system such as shown in U.S. Pat. No. 3,802,956. The apparatus, according to the present invention, includes a relatively low pressure first system including a source of fiber material in treatment liquid, a means for continuously removing liquid from the first system to maintain the system at relatively low pressure, means for transferring fiber material in treatment liquid in the first system to a second relatively high pressure system (said means including a conventional Kamyr high pressure pocketed-rotor transfer device), a conventional Kamyr high pressure vertical fiber material treatment vessel (i.e., digester), the second pressure system including an upper impregnation portion of the fiber material treatment vessel, means for selectively allowing or blocking communication between the second system and the fiber material treatment vessel so that the pressure in the second system is substantially as high as the treatment vessel pressure when communication between the second system and the the treatment vessel is allowed, and so that the pressure in the second system becomes significantly reduced when communication between the second system and the treatment vessel is terminated, and timing means for controlling the selective communication means to control the relative times the second system is exposed to high and low pressure so that impregnation of fiber material with treatment liquid takes place in the second system. The fiber material and liquid in the first system may be at a small super-atmospheric pressure of about 1 atmosphere, while the digester pressure (and the pressure phase in the second system during the high pressure thereof) is about 10 atmospheres. The conventional transmission device utilized for providing transfer of fiber material and liquid from the first system to the second system operates so that the flow between the first system and the second system is substantially continuous. (Steam treatment of the fiber material before it is actually fed to the transmission device is possible to remove the majority of the air in the fiber material.) Complete impregnation of the fiber material with treatment liquid takes place in the second system.

According to the method of impregnating fiber material with treatment liquid, according to the present invention (utilizing a high pressure treatment vessel having an upper impregnation chamber), a first flow system of fiber material and treatment liquid under relatively low pressure is established, liquid is continuously withdrawn from the first system so the pressure therein is reduced unless supplemental liquid is provided, a second flow system of fiber material and treatment liquid under relatively high pressure is established, fiber material in treatment liquid in the first system is transferred to the second system, the second system including the impregnation chamber of the fiber material treatment vessel, communication between the second system and the treatment vessel is selectively allowed or blocked so that the pressure in the second system is substantially as high as the treatment vessel when communication between the second system and the second treatment vessel is allowed, and so that the pressure in the second system becomes significantly reduced when communication between the second system and the treatment vessel is blocked, and the time that communication between the second system and the treatment vessel is effected is controlled so that the relative times that the second system is exposed to high and low pressure is controlled so that impregnation of fiber material with treatment liquid takes place in the second system.

It is the primary object of the present invention to provide an improved method and apparatus for the impregnation of fiber material with treatment liquid, by effecting the impregnation through pressure fluctuation in a simple system. This and other objects of the invention will become clear from an inspection of the detailed description of the invention and the appended claims.

DETAILED DESCRIPTION OF THE INVENTION

Figure 1:
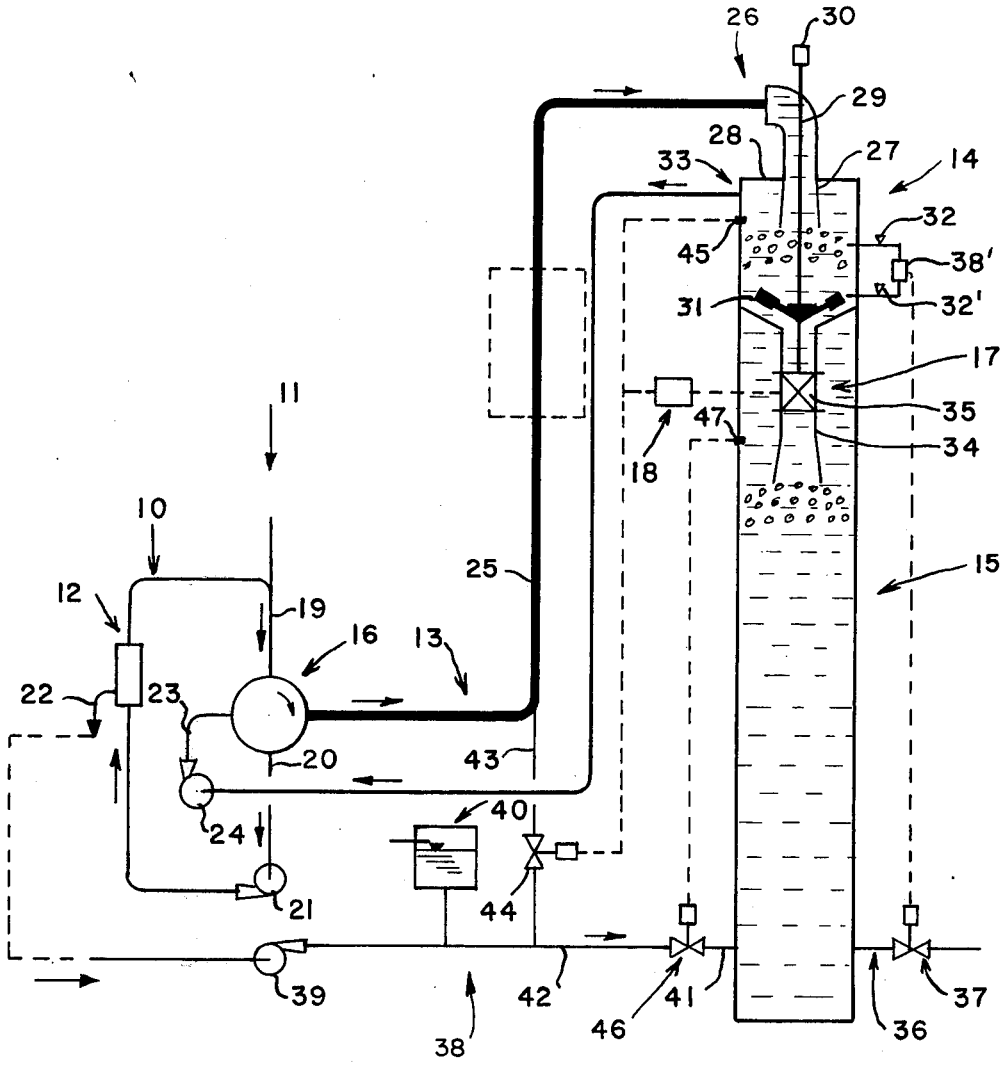
FIG. 1 is a schematic showing of exemplary apparatus for effecting fiber material impregnantion with treatment liquid according to the present invention.

Exemplary apparatus, according to the present invention, is shown schematically in FIG. 1. The major component parts of the apparatus of FIG. 1 include a relatively low pressure system (or defining means) 10 including a source 11 of fiber material in treatment liquid, means 12 (a screen device) for continuously removing liquid from the first system 10 to maintain the system at relatively low pressure, a second relatively high pressure system (or defining means) 13 including an upper impregnation chamber 14 of a conventional high pressure continuous treatment vessel (i.e., Kamyr digester) 15, means 16 for transferring fiber material and the impregnation liquid in the first system to the second system and boosting the pressure thereof, the means 16 comprising a conventional high pressure transfer device having a pocketed rotor, means 17 for selectively allowing or blocking communication between the second system and the fiber material treatment vessel 15 so that the pressure in the second system 13 is substantially as high as the treatment vessel pressure when communication between the second system 13 and the treatment vessel 15 is allowed, and so that the pressure in the second system 13 becomes significantly reduced (by removal of liquid therefrom — indirectly — by screening means 12) when communication between the second system and the treatment vessel is terminated, and timing means 18 for controlling the selective communication means 17 to control the relative times that the second system 13 is exposed to high and low pressure so that impregnation of fiber material with treatment liquid takes place in the second system 13.

The first system 10 includes an inlet line 19 to the transfer device 16, an outlet line 20 from the transfer device 16, a pump 21 disposed in the outlet line, and an outlet line 22 for liquid from the screening means 12. The screening means 12 may be any conventional dewatering device. The second system 13 includes an inlet line 23 to the transfer device 16, a pump 24 being disposed in the inlet line 23, and an outlet line 25 extending from the transfer device 16 opposite the inlet line 23. The outlet line 25 need not be in the form of a constant diameter conduit, but may bulge into a vessel, tank, or other suitable means (shown in dotted line in FIG. 1). The line 25 is connected to the feed-in 26 for the impregnation chamber 14.

As shown in the drawings, the impregnation chamber 14 and the feed-in 26 therefor are substantially the same as an individual chamber in my copending application Ser. No. 592,659 now U.S. Pat. No. 4,028,171. A pipe 27 extends a significant distance past the top 28 of chamber 14 into the chamber 14, and rotatable shaft 29 driven by a motor 30 extends into the chamber 14, a scraper device or distribution means 31 being provided at the end of the shaft 29 just above the outlet from the chamber 14 into the vessel 15. Fiber material in chamber 14 establishes a certain level 32 therein, and in order to provide screenless withdrawal of liquid from chamber 14, a withdrawal conduit 33 is disposed above the level 32 (that is above the bottom of the inlet 27). A more or less "stilling well" is provided in the chamber 14. The conduit 33, of course, is connected to the inlet line 23 to the transfer device 16.

While screenless withdrawing means have been disclosed in the drawing, conventional screen withdrawing means may be provided if desired.

A funnel-like conduit 34 extends between the impregnation chamber 14 and the treatment vessel 15, as more fully shown in my application Ser. No. 592,659 now U.S. Pat. No. 4,028,171. According to the present invention, a valve 35 is disposed in the inverted funnel-like conduit 34, the conduit 34 and the valve 35 defining the means 17 for selectively allowing or blocking communication between the second system 13 and the vessel 15. The treatment vessel 15 may be any suitable conventional treatment vessel, such as a Kamyr continuous digester, and an outlet pipe for digested fiber material from the vessel 15 may be provided, as shown at outlet 36 in FIG. 1. A valve 37 may be provided in the outlet 36, and control of the valve 37 may be effected by a regulator 381 which is responsive to the levels 32, 32' of the fiber material in impregnation chamber 14.

The valve 35 is controlled by a conventional timing means 18, the timing means 18 controlling the valve 35 so that when no communication is allowed between the chamber 14 and the vessel 15 the pressure in the second system 13 is reduced by withdrawal of liquid from the first system 10 by screening means 12. When the valve 35 is open the second system 13 communicates with the treatment vessel 15, and is at substantially the same pressure as the vessel 15.

The reduction in pressure in the system 13 as a result of the closing of valve 35 takes place as follows: The liquid in system 10 circulates through a vertical rotor 16 pocket while the chips are retained in the pocket, therefore, the pocket contains a comparatively small quantity of liquid. When the respective rotor 16 pocket turns to the horizontal, the relatively small quantity of liquid enters the high-pressure system 13. The chips and relatively small quantity of liquid in the rotor 16 pocket are replaced with a relatively large quantity of liquid from line 23 (ultimately from chamber 14), which relatively large quantity of liquid enters the first system 10 when the rotor 16 pocket again assumes a vertical position to receive more chips from line 19. This transfer of a relatively large quantity of liquid from system 13 into system 10 in exchange for a relatively small quantity of liquid results in a reduction of pressure in system 13 when the valve 35 is closed. Also, it is noted that communication between the systems 10 and 13 naturally takes place by leakage at the rotor 16, the rotor 16 comprising a conventional Kamyr, Inc. transfer device which, by design, has leakage from the high pressure system to the low pressure system.

In order to provide a smooth transition between the high and low pressure modes of the system 13 during each fluctuation cycle, a transition means — shown generally at 38 in FIG. 1 — is provided. Means 38 includes a source of high pressure treatment liquid (i.e., a high pressure pump 39 and/or a liquid accumulator 40, and also preferably the treatment vessel 15, a line 41 extending from the bottom portion of the treatment vessel 15 and in common communication with a high pressure line 42), and a line 43 extending between the high pressure line 42 and the outlet line 25 from transfer device 16 in second system 13. A first valve means 44 is disposed in the line 43, the valve means 44 being controlled both by the timing means 18 and by a pressure sensor 45 in the impregnation chamber 14. The valve means 44 is controlled by the timing means 18 and the pressure sensor 45 so that when valve 35 is open valve means 44 is open and so that when valve 35 is closed valve 44 is either completely closed, or partly closed so that only a small amount of make-up liquid flows through the line 43 into the second system 13. A second valve means 46 is provided in the line 41 extending from the treatment vessel 15, the second valve means 46 being controlled by the pressure sensor 47 in treatment vessel 15, coordination between the sensors 47 and 45 being provided. With the transition means 38, when the system 13 is changing from the low pressure mode to the high pressure mode, valve 35 is retained closed while valve 44 is opened to allow high pressure flow into the system 13 from the line 42, and only when the pressure sensor 45 indicates that the pressure in chamber 14 is substantially the same as in the treatment vessel 15 will the timing means 10 be allowed to open the valve 35. In this way, fluctuations of the pressure in treatment vessel 15 are avoided despite the fluctuations in the second system 13.

Figure 2:
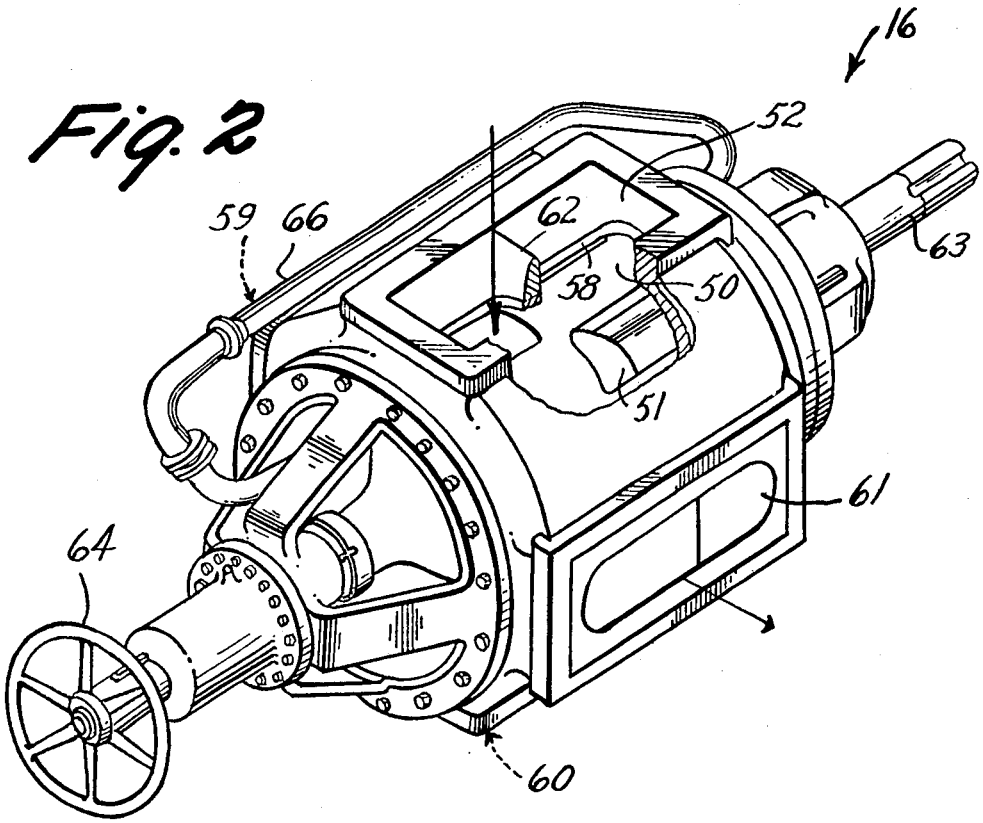
FIG. 2 is a perspective view of the high pressure transfer device of FIG. 1.
Figure 3:
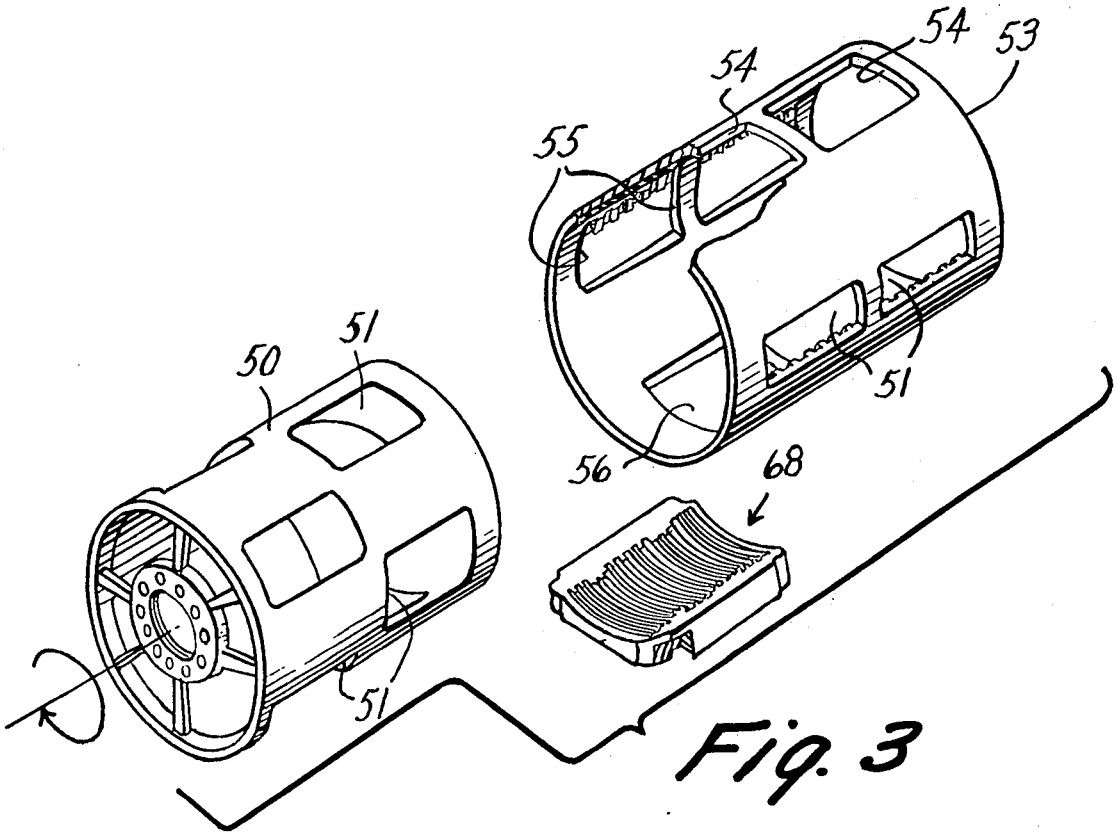
FIG. 3 is an exploded perspective view illustrating certain parts of the transfer device of FIG. 2.

The transfer device 16 is shown more clearly in FIGS. 2 and 3. The transfer device 16 includes a pocketed rotor 50 containing two rows of through-extending pockets 51, each row containing two through-going pockets perpendicular to each other presenting four open ports equally spaced around the periphery of the rotor for each row. The two rows of pockets are parallel, one row being substantially 45° displaced peripherally from the adjacent row as shown in FIG. 3. The pocketed rotor 50 is encased by housing 52 and mounted for rotation within a housing liner 53. As best shown in FIG. 3, the liner 53 includes four ports 54, 55, 56, and 57, equally spaced around the periphery of the housing, which register respectively with inlet 58, inlet 59, outlet 60, and outlet 61. Inlet 58 is connected to line 19, inlet 59 is connected to line 23, outlet 60 is connected to line 20, and outlet 61 is connected to line 25. Each port is more than twice as wide as the sum of two pockets in the pocketed rotor and a divider 62 is located midway in each housing port separate the same into two parallel ports, as clearly depicted in FIG. 2 and 3. Drive shaft 63 is connected to pocketed rotor 50 to rotate the same within the liner 53. Screen 68 is provided in port 56 of liner 53 to allow passage liquid through outlet 60, but little fiber material.

The pocketed rotor 50 may be either cylindrical or tapered; the rotor 50 is shown in FIG. 2 and 3 as tapered with the rotor diameter increasing in the direction of a clearance adjusting handwheel 64. Tapering of the rotor 50 provides for adjustments of the clearance between the rotor 50 and the housing liner 53; additionally, increase in clearance due to wear can be taken up by turning handwheel 64 and pushing rotor 50 toward the drive shaft end 63 shown in FIG. 2. The pockets 51 through rotor 50, in a row, loop over each other so as to provide passage through the rotor while maintaining in line openings in the rotor around the periphery of the rotor. A housing equalizing line 66 may be provided if desired. The transfer device 16 is conventional, and may be purchased on the market from Kamyr Inc.

Exemplary apparatus, according to the present invention, now having been described, a typical operating sequence therefor will now be set forth. A flow of fiber material from a source 11 is established in a first flow system 10 in treatment liquid under relatively low pressure (i.e., just above 1 atmosphere). Liquid is continuously withdrawn from the first system 10 by the screening means 12. A second flow system of fiber material and treatment liquid under relatively high pressure (i.e., 10 atmospheres) is established as shown in 13, the second flow system including the impregnation chamber 14 of the treatment vessel 15. Fiber material and liquid in system 10 is drawn into transfer device 16 through line 19 by pump 21, into a pocket 51 of the transfer device 16, the pocket rotating around until it is in line in system 13, and liquid under high pressure from pump 24 passing through transfer device 16 entraining the fiber material and liquid from line 19 therein and thereby transferring it to the second system 13. The fiber material and liquid passes through conduit 25 to the feed means 26 for the chamber 14, the fiber being established in a column (i.e., level 32) and ultimately being fed by scraper 31 to establish another column in the treatment vessel 15. Liquid is continuously withdrawn through withdrawal means 33 in the upper portion of impregnation chamber 14 to provide a closed second system 13. With the valve 35 open, free communication between chamber 14 and vessel 15 is allowed, and the whole system 13 is maintained at the treatment vessel pressure (i.e., 10 atmospheres). Once the pressure in the second system 13 has been maintained at the high level for a certain period of time (i.e., 10–60 seconds), a low pressure mode of a fluctuation cycle is induced. This is accomplished by the timing means 10 closing the valve 35, and simultaneously closing the valve 44. Then, the second system 13 has no communication with any outside system except the first system 10, which is at relatively low pressure, and since liquid is continuously withdrawn from system 10 through screening means 12, the pressure in the system 13 is gradually reduced. A relatively larger volume of liquid passes from system 13 into system 10 than from system 10 to system 13, and the high pressure transfer valve 16 inherently provides leakage from one system to the other. In order to maintain the pressure in the system 13 at a reasonably high level, however, after a predetermined period of time the timing means 10 may partially open the valve 44 so that a small amount of make-up liquid under high pressure is introduced into the system 13 from the high pressure line 42. Once the system 13 has been maintained in the low pressure mode the desired period of time (i.e., 5–30 seconds if the high pressure mode time is about 10–60 seconds), the fluctuation cycle is completed by returning the system 13 to the high pressure mode.

It is in returning system 13 to the high pressure mode that the transition system 38 comes into play. The timing means 18 opens the valve 44 completely so that free communication between the high pressure line 42 and the second system 13 is provided, the instantaneous influx of liquid being very great due to the provision of accumulator 40 in system 38, the high pressure pump 39, and also preferably due to the opening of valve 46 by the control means 47 if the pressure differential sensed by the means 47 and 45 is significantly large. When the pressure in upper chamber 14 sensed by the sensor 45 becomes substantially as great as the pressure in vessel 15 sensed by sensing means 47, the timing means 18 is allowed to open the valve 35, thereby again providing free communication between the impregnation chamber 14 and the treatment vessel 15. The valve 44 is also retained open until the initiation of another low pressure mode is desired, at which time the valve 44 is closed simultaneously with the closing of valve 35.

The pressure fluctuation so induced in the second system 13 results in the displacement of air from the fiber material in the system 13, and the replacement of the air with treatment liquid (i.e., digesting liquid). The fluctuation between high and low pressure may be controlled so that the second system fluctuates three times during a time period of 1–5 minutes. As suggested above, it is desirable for maximum impregnation that the pressure be kept high in the second system for a longer period of time than it is kept low pressure 5–20 seconds during each fluctuation cycle. While the invention has primarily been described with respect to digesting of fiber material, it will be understood that any type of fiber treatment that requires impregnation with a particular treatment liquid may be accomplished.

Thus, it will be seen that according to the present invention an apparatus and method have been provided which effect impregnation of fiber material with treatment liquid with a minimum of accessory equipment. For instance, the conventional presteaming device utilized in prior art structures has been eliminated, and the complicated pressure variation impregnation apparatus disclosed in Swedish Pat. No. 174,656 has been avoided. Essentially, the valve 35, the conduit 34 (and suitable controls therefor) and screening means 12 in first system 10, are the only added equipment needed over the conventional system, while the conventional presteaming equipment has been eliminated. Thus, more economical apparatus has been provided with a savings in floor space. At the same time the extent of impregnation, according to the present invention, is not believed diminished relative to the impregnation possible with oprior art structures.

While the invention has been herein shown and described in what is presently conceived to be the most practical and preferred embodiment, it will be obvious to one of ordinary skill in the art that many modifications may be made thereof within the scope of the invention, which scope is to be accorded the broadest interpretation of the appended claims so as to encompass all equivalent structures and methods.

What is claimed is:

1. Apparatus for impregnating fiber material with treatment liquid before treatment thereof, comprising a. a first means defining a relatively low pressure system, including fiber material in impregnation liquid;

b. means for continuously removing liquid from said first system to maintain said system at relatively low pressure;

c. means for transferring fiber material in impregnation liquid in said first system to a second means defining a relatively high pressure system and boosting the pressure thereof, said transferring means including means communicating with both said first and second systems;

d. a high pressure vertical fiber material treatment vessel;

e. said second pressure system including an upper impregnation portion of said fiber material treatment vessel;

f. means for selectively allowing or blocking communication between said second system and said fiber material treatment vessel so that the pressure in said second system is substantially as high as said treatment vessel pressure when communication between said second system and said treatment vessel is allowed, and so that the pressure in said second system and said treatment vessel is allowed, and so that the pressure in said second system becomes significantly reduced when communication between said second system and said treatment vessel is terminated; and g. timing means for controlling said selective communication means to control the relative times that said second system is exposed to said pressure substantially as high as said treatment vessel pressure, and said significantly reduced pressure, so that impregnation of fiber material with treatment liquid takes place in said second system.

2. Apparatus as recited in claim 1 wherein said means for transferring fiber material in impregnation liquid in said first system to said seccond system and boosting the pressure thereof to include a transfer device having an inlet from said first system, an outlet from said first system opposite said inlet, an inlet from said second system and an outlet from said second system opposite said inlet, a pump disposed in the outlet line from said first system outlet and a pump disposed in the inlet line from said second system inlet, and a pocketed rotor for providing communication between said first system inlet and outlet, and said second system inlet and outlet.

3. Apparatus as recited in claim 2 wherein said second systems comprises a generally closed system including the inlet and outlet lines from said transfer device and the impregnation chamber of said treatment vessel, said device outlet line being connected to said impregnation chamber inlet, and said transfer device inlet line being connected to a liquid withdrawing portion of said impregnation chamber, and wherein said selective communication means comprise a valve disposed in an inverted funnel-like conduit extending between the impregnation chamber and the treatment vessel.

4. Apparatus as recited in claim 3 wherein said timing means is operatively connected to a pressure sensor in said impregnation chamber and is further connected to a valve means disposed in means defining a system for providing smooth transition of said second system from low to high pressure without disturbing operation of said treatment vessel.

5. Apparatus as recited in claim 4 wherein said transition system includes means defining a source of high pressure treatment liquid, and a connecting line extending between said source of high pressure treatment liquid and the outlet line from said transfer device in said second system, said valve means being disposed in said connecting line.

6. Apparatus as recited in claim 5 further comprising means for providing communication between a bottom high pressure portion of said treatment vessel and said high pressure source of treatment liquid, said means including a line having a second valve means disposed therein, and a second pressure sensor sensing the pressure in said treatment vessel and comparing it to the pressure in said impregnation chamber for controlling operation of said second valve means.

7. Apparatus as recited in claim 3 wherein said liquid withdrawing portion of said treatment vessel upper chamber comprises a screenless liquid withdrawing means.

8. A method of impregnating fiber material with treatment liquid before treatment thereof in a high pressure treatment vessel having an upper impregnation chamber comprising the steps of a. establishing a first flow system of fiber material and treatment liquid under relatively low pressure;

b. continuously withdrawing liquid from said first system so that the pressure therein is reduced unless supplemental liquid is provided;

c. establishing a second flow system of fiber material and treatment liquid under relatively high pressure;

d. transferring fiber material in treatment liquid in said first system to said second system and boosting the pressure thereof, said second system including the impregnation chamber of the fiber material treatment vessel;

e. selectively allowing or blocking communication between said second system and said treatment vessel so that the pressure in said second system is substantially as high as said treatment vessel pressure when communication between said second system and said treatment vessel is allowed, and so that the pressure in said second system becomes significantly reduced when communication between said second system and said treatment vessel is blocked; and f. controlling the time that communication between said second system and said treatment vessel is effected to control the relative times that said second system is exposed to high and low pressure so that impregnation of fiber material with treatment liquid takes place in said second system.

9. A method as recited in claim 8 wherein the selective communication between said second system and said treatment vessel is controlled so that said second system fluctuates between relatively high and low pressure three times during a time period of 1–5 minutes.

10. A method as recited in claim 9 wherein the selective communication is controlled so that the pressure in said second system is kept high for a longer period of time than it is kept low for each fluctuation cycle.

11. A method as recited in claim 10 wherein the pressure in said second system is kept high from 10–60 seconds during each fluctuation cycle, and low from 5–30 seconds during each fluctuation cycle.

12. A method as recited in claim 8 comprising the further step of feeding treatment liquid under high pressure to said second system during transition of said second system from low pressure to high pressure during each fluctuation cycle in order to minimize pressure fluctuation in said treatment vessel as a result of pressure fluctuations in said second system.

13. A method as recited in claim 8 wherein the pressure in the treatment vessel, and in the second system during communication thereof with the treatment vessel, is about 10 atmospheres.

14. A method as recited in claim 13 wherein the pressure in the first system is about slightly more than 1 atmosphere.

15. A method as recited in claim 8 wherein the treatment liquid is digesting liquid, and comprising the further step of digesting the impregnated fiber material in the treatment vessel.

* * * * *

UNITED STATES PATENT OFFICE

CERTIFICATE OF CORRECTION

Patent No. 4,057,461 Dated November 8, 1977

Inventor(s) Johan C. F. Richter

It is certified that error appears in the above-identified patent and that said Letters Patent are hereby corrected as shown below:

In the heading, section (22), "Aug." should be -- May --.

Column 1, line 24, "it" should read -- It --.

Column 1, line 54, insert -- a -- after "and".

Column 2, line 7, delete "the" before "treatment".

Column 3, line 59, insert -- a -- after "and".

Column 4, line 20, "381" should read -- 38' --.

Column 5, line 45, insert -- of -- after "passage".

Column 7, line 31, "oprior" should read -- prior --.

Column 8, line 25, "systems" should read -- system --.

Signed and Sealed this

Twelfth Day of December 1978

[SEAL]

Attest:

RUTH C. MASON
Attesting Officer

DONALD W. BANNER
Commissioner of Patents and Trademarks